United States Patent [19]

Zovath et al.

[11] Patent Number: 4,745,383

[45] Date of Patent: May 17, 1988

[54] MAGNETIC PROXIMITY SWITCH

[76] Inventors: Peter J. Zovath, 12914 N. Hunters Cir., San Antonio, Tex. 78230; John T. Schutzmaier, 2258 Shadowdale, Houston, Tex. 77043

[21] Appl. No.: 48,663

[22] Filed: May 11, 1987

[51] Int. Cl.[4] ..... H01H 9/00

[52] U.S. Cl. ..... 335/181; 335/205; 335/302

[58] Field of Search ..... 335/181, 182, 205, 207, 335/302, 206, 236

[56] References Cited

U.S. PATENT DOCUMENTS

| | | | |
|---|---|---|---|
| 2,793,265 | 5/1957 | Crissinger . | |
| 3,121,148 | 2/1964 | Wells et al. . | |
| 3,176,096 | 3/1965 | Marcum | 335/205 |
| 3,295,023 | 12/1966 | Peras | 335/207 |
| 3,325,756 | 6/1967 | Maxwell | 335/207 |
| 3,348,176 | 10/1967 | Gullett . | |
| 3,361,995 | 1/1968 | Marcum | 335/196 |
| 3,673,527 | 6/1972 | Wolf | 335/207 |
| 3,732,512 | 5/1973 | Puttick | 335/207 |
| 3,739,309 | 6/1973 | Dalton . | |
| 3,832,658 | 8/1974 | Hayden . | |
| 4,117,431 | 9/1978 | Eicher | 335/207 |
| 4,225,837 | 9/1980 | Fowler | 335/207 |

*Primary Examiner*—E. A. Goldberg
*Assistant Examiner*—Lincoln Donovan
*Attorney, Agent, or Firm*—Suzanne Kikel

[57] ABSTRACT

A magnetically operated proximity device is provided with a pivotal armature formed as a hat in cross section with two L-shaped members, one being longer and greater in mass than the other. The horizontal leg of each L-shaped member is arranged such as to contact an electrical contact. The greater surface area of the L-shaped members enhance the sensitivity of the device, with the horizontal leg of each L-shaped member extending over a different pole face of a permanent magnet.

9 Claims, 1 Drawing Sheet

MAGNETIC PROXIMITY SWITCH

BACKGROUND OF THE INVENTION

1. Field of the Invention

This invention relates to magnetic proximity sensing devices, and more specifically, to a design for a pivoting armature and its cooperation with different polarities of permanent magnets for enhancing the sensitivity of the device.

2. Description of the Prior Art

In general, magnetically actuated proximity switches are used to sense relative movement between two members; one being the switch itself, and the other being a magnetically permeable member of either iron or steel.

U.S. Pat. No. 4,225,837 discloses a pivotal armature which carries the contacts and which is provided at its ends with magnetically permeable lips extending toward the marginal area of the same magnetic sign pole faces of permanent magnets with which the armature cooperates. In order to create a greater pull or to maintain the pivotal armature in a horizontal disposition, a lesser air gap between the magnet and the armature exists on the one side of the device with a greater air gap on the other side. This magnet spacing between the lips requires that both magnets be identical in strength in their magnetic pull so as to eliminate the possibility of the magnetic influence from varying during operation of the switch. The pole faces of the magnets influencing the lips of the contact bridge is of the same polarity sign. The providing of identical polarity magnets requires labor intensive testing and manual positioning and respositioning of the magnets in order to attain the required magnetically flux intensity. Also, the method for decreasing the strength of one pole of the same magnet to create flux differential requires sophisticated equipment and test facilities to insure that the correct amount of imbalance for pivotal movement of an armature is consistently achieved in the operation of the device.

Other examples of magnetically operating proximity sensing devices are disclosed in U.S. Pat. Nos. 3,176,096; 3,325,756; 3,361,995; 3,673,527; 3,732,512; and 4,117,431.

There is lacking in the prior art, particularly in the switch design of the former U.S. Pat. No. 4,225,837, the ability to consistently obtain an adequate contact pressure between the electrical contacts of the switch at reasonable sensing distances. There is further lacking such a device capable of providing ample current carrying capabilities of the contact member. There is further lacking in the prior art disclosures the teaching of non-spacing of the magnets or non-weakening of the magnetic fields which conventionally provides magnetic imbalance to allow the pivoting or movement of the armature.

There is further lacking in the prior art a design for an armature which eliminates the need for mounting a pair of contacts whose cooperation with another pair of contacts operates the device. There is further lacking in the prior art an armature having means extending towards its opposed ends having different lengths and masses cooperating with different pole faces of an associated permanent magnet. There is further lacking in the piror art means extending from the opposed ends of a pivotal armature employed as both a contact surface and a means for enhancing sensitivity. There is further lacking in the prior art a proximity switch which does not require labor intensive testing and manual positioning of the magnets for its optimum operation.

SUMMARY OF THE INVENTION

The present invention has solved the abovedescribed problems by providing an inexpensive magnetic proximity switch adapted to provide optimum sensitivity, and operation thereof. The shape of the armature eliminates the need for ancillary contacts on the armature and the need for disposing one permanent magnet in a different elevation with respect to the other permanent magnet for the required spacing for pivotal movement of the armature. The magnets have different polarities at their ends influencing the magnetic force on the ends of the armature, resulting in better balance of the armature.

It is a broader object of this invention to provide a magnetic proximity switch which is efficient, smaller in size, and simple in design and operation, requiring a minimum of testing and manual "trial and error" of the placement of the magnets in the device.

It is a further object of the invention to provide a magnetic proximity switch having a pivotal armature with different mass and length means, thereby eliminating the need for different spacing of the magnets for creating an air gap necessary for pivoting the armature for the necessary electrical contact.

It is a further object of the invention either to provide a single pole, double throw or double pole, double throw magnetic proximity switch having multi-pole magnets whose different polarities extend adjacent to the armature for creating a magnetic field with flux lines running longitudinally of the device.

A further object of the invention is to provide a proximity switch with an armature which can be machined or formed to control the mass at the opposed ends of the contact bridge for accurate switch activation. The components of the switch can be made relatively small so that the housing for the switch can be small compared to prior art proximity switches.

These and other objects of the invention will be more fully understood from the following description of the invention, on reference to the illustrations appended hereto.

DESCRIPTION OF THE PREFERRED EMBODIMENTS

Figure 1:
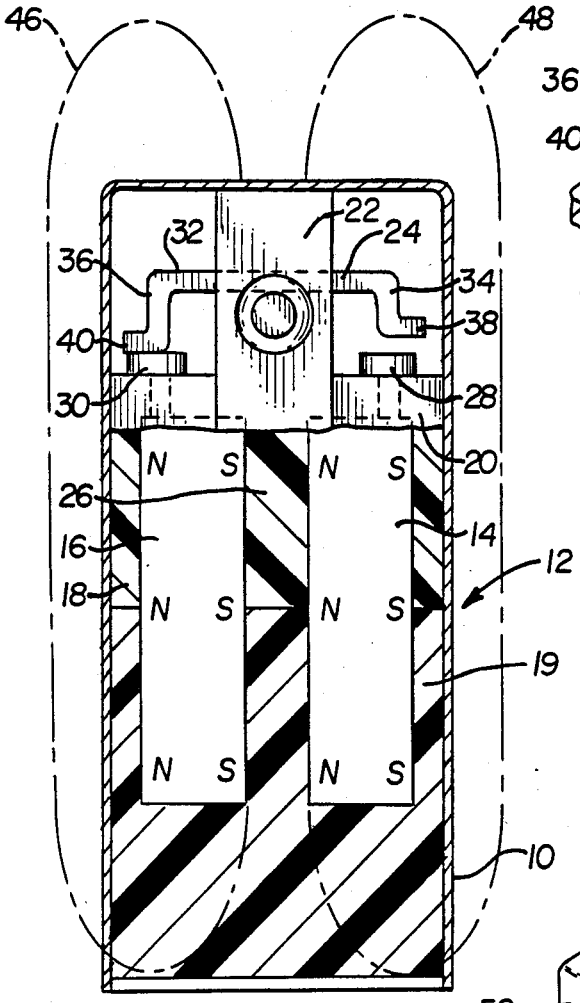
FIG. 1 is a longitudinal section showing a preferred form of the invention and the flux lines for the magnetic field.

FIG. 1 illustrates an outer housing 10 containing a magnetically operated proximity switch 12 employing multi-pole permanent magnets 14, 16 in an inner housing 18. Housing 18 consists of a horizontal member 20 and two upright members (one of which is shown at 22) into which armature 24, which is magnetically permeable, is pivotally mounted.

Housing 18 has an inner portion 26 extending to separate magnets 14, 16, and dividing housing 18 into two pockets for receiving magnets 14, 16. Preferably, housing 18 is made of a shock absorbing epoxy resin capable of withstanding heat up to a temperature of 300° F. A pair of contacts 28, 30 are fastened through suitable means in horizontal member 20, which is part of 18 and are connected, by means not shown, to suitable terminals in outer housing 10, which extend in a conventional manner therefrom. Contacts 28, 30 preferably are screwed or molded in tightly to increase the ampere rating on the switch.

Figure 2:
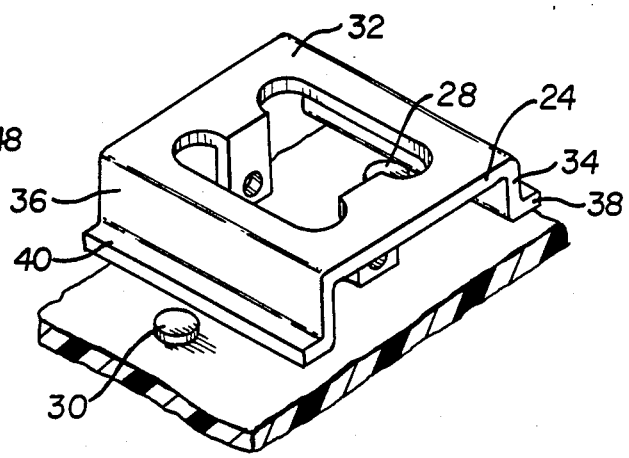
FIG. 2 is a perspective view of one embodiment of the invention.

Armature 24 consists of a central area 32 as shown in FIG. 2 which is pivotally mounted in the two upright members 22. As shown in FIG. 1, armature 24 has two opposed L-shape members 34, 36 extending down from main central area 32. These L-shape members 34, 36 each has a lower horizontal leg 38, 40 respectively. Each leg 38, 40 is positioned such as to make pressure contact with contacts 28, 30 which, in turn, as mentioned above is connected to an electrical connection for operation of the desired machinery.

The lower horizontal legs 38 and 40 extend outwardly in the direction shown in FIG. 1 away from a vertical portion of L-shape members 34, 36 respectively, which direction is parallel to the normal plane in which armature 24 is positioned. The vertical portion of each L-shape members 34, 36 respectively, is directed toward its respective magnet 14, 16 as shown in FIG. 1, and may assume this positioning in a first operative mode. Conversely, in a second operative mode, armature 24 may be pivoted to the right of FIG. 1, whereby horizontal legs 38 and 40 are disposed at an angle relative to their respective magnets 14, 16, more about which will be discussed shortly. Preferably armature 24 is of a low carbon steel.

Referring again to FIG. 1, the vertical portions of L-shape members 34 and 36, respectively vary in length relative to each other; with that of member 36 being longer than that of member 34. Horizontal leg 40, as well as horizontal leg 38, extends parallel to the normal plane of armature 24. As mentioned previously, the length of the vertical portion of L-shape member 34 is less than that of L-shape member 36.

This difference in lengths for the vertical portions of L-shape members 34, 36 results in a varying mass for members 34, 36 where the mass of L-shape member 36 cooperating with electrical contact 30 is greater than that of L-shape member 34 cooperating with electrical contact 28.

This greater mass of L-shape member 36 provides a greater magnetic influence on armature 24 so that with no exterior influence, contact is made and maintained between the contacting surface of horizontal leg 40 of L-shape member 36 and contact 30 thereby always biasing armature 24 in the left direction as shown in FIG. 1.

The shorter length of L-shape member 34 creates an air gap between magnet 14 and its horizontal leg 38 which is slightly greater than the gap between magnet 16 and horizontal leg 40 of L-shape member 36. The shorter air gap, in conjunction with the lesser mass of member 34 provides greater magnetic pull so that L-shape member 36 located to the left of FIG. 1 remains in its biased positioning as shown.

Permanent magnets 14 and 16 generally consist of two pole portions as shown in FIG. 1, whereby the left side is of one pole indicated by an "N" and the right side is of an opposing pole indicated by an "S." L-shape member 36 is in close proximity to the north pole of its cooperating magnet 16 creating the magnetic flux lines shown at 46 and L-shape member 34 is in close proximity of the south pole of its cooperating magnet 14 creating the flux lines shown at 48.

When a body of ferromagnetic material enters the magnetic flux area adjacent to L-shape member 36 which generally creates a closed contact, the magnetic field is interrupted by diverting the magnetic flux resulting in a weakened magnetic pull for L-shape member 36. Thereupon, armature 24 is caused to be pivotted to the stronger magnetic field existing to the right of FIG. 1 between L-shape member 34 and contact 28. It has been the experience of the inventor that the invention operates in the above described manner with the respective poles of magnets 14, 16 in their positioning relative to L-shape members 36, 40 as shown in FIG. 1.

Figure 3:
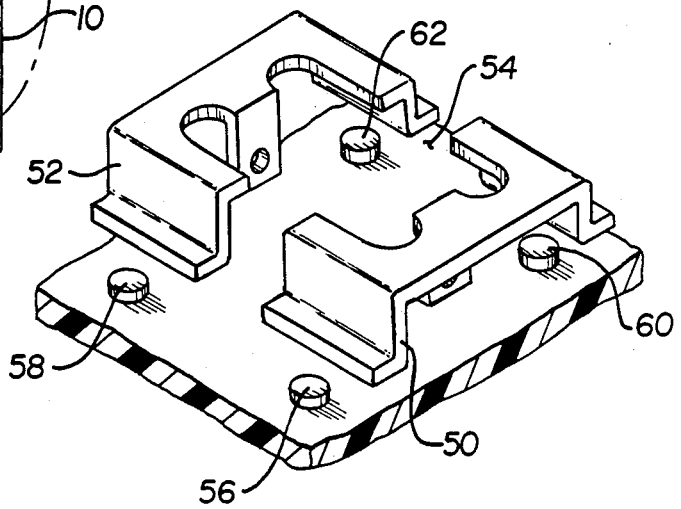
FIG. 3 is a perspective view of a second embodiment of the invention.

FIG. 2, as mentioned previously, is a first embodiment of the invention whereby armature 24 is a single pole, double throw contact bridge. FIG. 3 is a second embodiment illustrating two armatures 50 and 52 for a double pole, double throw contact bridge. In this arrangement armatures 50 and 52 are separated by an air gap 54 creating insulation therebetween, and electrical contacts 56, 58, 60 and 62 are positioned directly beneath the L-shape members of armatures 50 and 52 direct contact therewith in a manner similar to the operation of the first embodiment of FIG. 1. Alternatively, armatures 50 and 52 may be held together with a high temperature, high dielectric strength epoxy.

Whereas particular embodiments of the invention have been described above for purposes of illustration, it will be evident to those skilled in the art that numerous variations of the details may be made without departing from the invention as defined in the appended claims.

We claim:

1. A magnetic proximity switch, comprising:

a pivotally mounted magnetically permeable armature means with a pivotal axis, and permanent magnet means having a different pole face adjacent to the end areas of said armature means, said armature means being pivotally movable from a first position to a second position when magnetic flux is diverted from said armature means upon the approach of a magnetically permeable operator, said armature means comprising a main body and a pair of magnetically permeable members depending from said main body and extending in the same direction, toward said magnet means for concentrating said flux of said magnet means along said pair of permeable members, said pair of permeable members having a similar configuration and dissimilar lengths and masses such that in said first position of said armature means the permeable member with the longer length and greater mass has a lesser air gap and a stronger magnetic field strength with respect to its respective magnet means and the permeable member with the shorter length and lesser mass has a greater air gap and weaker magnetic field strength relative to its said magnet means such as to change said magnetic field strengths to cause said pivotal movement of said armature means from its said first position to said second position upon said approach of said permeable operator.

2. A magnetic proximity switch according to claim 1, said switch having electrical contacts, and wherein said pair of permeable members are in an L-shape configuration in cross section with a lower portion of each member being adapted for selective contact with one of said electrical contacts.

3. A magnetic proximity switch according to claim 1, said switch having electrical contacts and wherein said permeable members each have a first portion extending perpendicularly to the normal plane of said axis of said armature means and a second portion adjacent to said first portion extending parallel to and in a different plane from said normal plane of said axis of said armature means, said second portion of each said permeable member adapted to come into contact with a different one of said electrical contacts.

4. A magnetic proximity switch according to claim 1, wherein said magnet means consists of at least two magnets with two different pole faces arranged laterally of said switch in the same plane parallel to and spaced away from the plane of the axis of said armature and wherein said each permeable member extends across and is adapted to be selectively effected by a said different pole face of one of said two magnets.

5. A magnetic proximity switch according to claim 1, wherein said armature means is a single contact bridge with a single pole, double throw.

6. A magnetic proximity switch according to claim 1, wherein said armature means consists of a pair of spaced-apart contact bridges comprising a double pole, double throw switch.

7. A magnetic proximity switch, comprising:

at least two electrical contact means, a permeable armature means with a pivotal axis in a plane normal to said armature means and, having two opposed end areas in close proximity to said electrical contact means, and pivotally movable from a first positioning to a second positioning upon the approach of a magnetically permeable operator, and a permanent magnet means associated with each of said end areas of said armature means, said armature means comprising a main body, a first magnetically permeable member at one said opposed end area, and a second magnetically permeable member at other said opposed end area, said permanent magnet means located in the same normal plane relative to each other, which plane is spaced away from and parallel to said plane of said axis of said armature, and having a different pole face in proximity to each of said permeable members at said opposed end areas of said armature means, said each first and second permeable members having a first leg and a second leg in an L-shape configuration in cross section and extending in the same direction away from said main body of said armature toward said different pole face of its said respective magnet means, said first leg of each member extending perpendicularly from said main body, and said second leg of each member extending immediately adjacent to and outwardly from said first leg in a different normal plane parallel to and spaced away from said plane containing said axis of said armature means, said first L-shape permeable member having a greater mass and being longer than said second permeable member such that a lesser spacing exists between said second leg of said first L-shape permeable member and its said respective magnet compared to that of said second L-shape member, said second leg of said first L-shape permeable member being adapted to be influenced by and positionable adjacent to the north pole of its respective magnet in contact with one of said electrical contacts in said first positioning of said armature means, and said second leg of said second L-shape permeable member being adapted to be influenced by and positionable adjacent to the south pole of its respective magnet in contact with the other of said electrical contacts in said second positioning of said armature means.

8. A magnetic proximity switch according to claim 7, wherein said armature means is a single contact bridge with a single pole, double throw.

9. A magnetic proximity switch according to claim 7, wherein said armature means consists of a pair of spaced-apart contact bridges comprising a double pole, double throw switch.

* * * * *